United States Patent [19]

Dautzenberg et al.

[11] 3,951,035

[45] Apr. 20, 1976

[54] METHOD OF MAKING DUMMY BULLETS

[75] Inventors: Norbert Dautzenberg, Meerbusch; Josef Hewing, Monchen-Gladbach; Max Michalke, Rheydt; Henri Weber, Monchem-Gladbach, all of Germany

[73] Assignees: Nederlandsche Wapen-en Munitiefabriek De Kruithoorn N.V., 's Hertogenbosch, Netherlands; Mannesmann Aktiengesellschaft, Dusseldorf, Germany

[22] Filed: Nov. 27, 1972

[21] Appl. No.: 309,866

[30] Foreign Application Priority Data

Dec. 1, 1971 Germany ..... 2160187

[52] U.S. Cl. ..... 86/10; 75/.5 BA; 102/92.7

[51] Int. Cl.[2] ..... F42B 5/22

[58] Field of Search ..... 75/.5 BA; 86/10; 102/92.7

[56] References Cited

UNITED STATES PATENTS

| | | | |
|---|---|---|---|
| 2,995,090 | 8/1961 | Daubenspeck | 102/92.7 X |
| 3,463,047 | 8/1969 | Germershausen | 102/92.7 X |
| 3,528,081 | 9/1970 | Huseby et al. | 75/.5 BA |
| 3,597,188 | 8/1971 | Neumann | 75/.5 BA |

FOREIGN PATENTS OR APPLICATIONS

| | | | |
|---|---|---|---|
| 965,889 | 8/1964 | United Kingdom | 102/92.7 |

*Primary Examiner*—Leland A. Sebastian
*Attorney, Agent, or Firm*—Ralf H. Siegemund

[57] ABSTRACT

An iron powder is compressed into a disintegrating bullet used for practice ammunition. The powder having a predetermined particle dimension is obtained by atomizing a molten mass of steel with pressurized water. The powder is annealed subsequently, then crushed, scrubbed and sieved to obtain particles at a size preferably between 0.4 to 1 mm.

5 Claims, No Drawings

METHOD OF MAKING DUMMY BULLETS

BACKGROUND OF THE INVENTION

The present invention relates in general to practice ammunition and more particularly to a method for the construction of disintegrating dummy bullets designed to be fired from a firearm.

Conventionally, disintegrating, dummy bullets are used in practice ammunition for automatic firearms and are manufactured in a powder-metallurgical manner by compressing a heavy-metal powder and by subsequently enclosing the resulting core in a jacket which, for example, may be made of a plastic material. For ballistic reasons, the bullet must have high density in excess of 7 g/cm$^3$. However, their compactness should be such as to permit complete disintegration into fine particles shortly after being discharged from the firearm. According to current standards, this requirement is met only when upon firing at a paper wall placed 80 meters from the firearm, no penetrations relating to the shell can be found in this wall. On the other hand, the bullets should be firm enough to prevent damage thereto or premature disintegration thereof during fabrication, transport or in the firearm before being discharged therefrom.

SUMMARY OF THE INVENTION

It is an object of the invention to provide a method which enables the construction of improved disintegrating bullets. According to this method an iron powder with particle dimensions between approximately 0.2 – 1 mm is used for the fabrication of the bullet core. The iron powder is obtained by atomizing a nonalloyed molten mass of steel having a low carbon content, by means of pressurized water. The resulting iron powder is subsequently reducible annealed, i.e., it is softened by subjecting the powder to heat at a temperature involved ranging from 900° – 1050° C. Thereafter, the substance is crushed and subjected to a scrubbing treatment, both of which steps are preferably accomplished in a hammer mill or swing hammer pulverizer. The thus treated powder is subjected to a filtering process to retain those particles having a standard grain size of 0.2 – 1 mm, but preferably with a size of 0.4 – 1 mm. The powder is then used in a press die or the like to obtain bullet cores, which are then jacketed, e.g., in plastic. The latter two steps are standard procedure and are per se not part of the invention.

It is advisable to use an iron powder which, after being broken-up and subjected to the above scrubbing and filtering process, has a density of 3.7 – 3.9 g/cm$^3$. In order to facilitate compression of the powder into a bullet core, a zinc stearate in a quantity of, for example, 0.5% may be added to the powder. The powder is then compressed to obtain density in excess of 7 g/cm$^3$. The compression is part of the bullet making process.

DESCRIPTION OF THE PREFERRED EMBODIMENT

The invention will be better understood from the following example:

A molten mass of steel having a temperature of 1650° C is poured from a ladle, and the falling stream of molten steel is subjected to jets of pressurized water of 30 atm. The steel is thereby atomized resulting in an iron powder with particle dimensions below 1.5 mm.

The atomized or pulverized iron, subsequently, is dehydrated and dried and is reducibly annealed in a reducing gas. The temperature involved in softening the powder in the annealing step, in this case, is 1000° C. Following this treatment, the iron is broken up and subjected to a scrubbing process for such a duration that the iron powder, after sieving to obtain powder at particle dimensions of 0.4 – 1 mm, has attained a density of 3.7 – 3.9 g powder per cm$^3$.

As indicated above, the iron particles, preferably, are broken up and subjected to the beating and scrubbing treatment in a hammer mill or swing hammer pulverizer. The powder so made is then compressed unter pressure of 6 to 8 metric tons per cm$^2$ to obtain densities in excess of 7 g/cm$^3$. This compression is part of the bullet core making process which proceeds otherwise along conventional lines.

The invention is not limited to the embodiments described above but all changes and modifications thereof not constituting departures from the spirit and scope of the invention are intended to be included.

We claim:

1. In a method for preparation of disintegrating dummy bullets by press-forming powder into a bullet core and, possibly, jacketing the core in plastic or the like, the improvement of using a powder made by atomizing a nonalloyed molten mass of steel having a low carbon content by means of pressurized water in the order of 30 atomospheres to form an iron powder having particle dimensions below 1.5 mm;

dehydrating and drying said thus-pulverized iron powder;

reducibly annealing said iron powder, the heating temperature involved in this step ranging between 900° – 1050°C;

breaking up said annealed iron powder as caked during annealing and subjecting the powder to a beating and scrubbing process;

sieving said thus-treated iron powder to obtain a powder at particle sizes of 0.2 – 1 mm at a density of 3.7 to 3.9 grams powder per cm$^3$; and compressing the resulting powder to obtain the dummy bullets with a density in excess of 7 g/cm$^3$.

2. Method according to claim 1, wherein said last-mentioned step comprises sieving said iron powder to a grain size of 0.4 – 1 mm.

3. Method according to claim 1, wherein said step of crushing and scrubbing said iron powder is carried out in a hammer mill or swing hammer pulverizer.

4. Method according to claim 1, wherein said step of compressing said iron powder comprises adding compression facilitating material to said iron powder as made.

5. Method according to claim 4, wherein said material comprises 0.5% of zinc stearate.

* * * * *